US009066637B2

(12) United States Patent
Zeng

(10) Patent No.: US 9,066,637 B2
(45) Date of Patent: Jun. 30, 2015

(54) SHOWER ROD WITH MACRO AND MICRO ADJUSTMENT

(76) Inventor: Qing Hai Zeng, Houston, TX (US)

( * ) Notice: Subject to any disclaimer, the term of this patent is extended or adjusted under 35 U.S.C. 154(b) by 581 days.

(21) Appl. No.: 13/367,285

(22) Filed: Feb. 6, 2012

(65) Prior Publication Data

US 2013/0198948 A1 Aug. 8, 2013

(51) Int. Cl.
*A47K 3/00* (2006.01)
*A47H 1/022* (2006.01)
*A47K 3/38* (2006.01)

(52) U.S. Cl.
CPC . *A47K 3/38* (2013.01); *A47H 1/022* (2013.01)

(58) Field of Classification Search
CPC ..... A47H 2001/0205; A47H 1/022
USPC ..... 4/610; 211/105.2, 105.4
See application file for complete search history.

(56) References Cited

U.S. PATENT DOCUMENTS 2,293,168 A * 8/1942 Pirone ..... 211/123
4,754,504 A * 7/1988 Cellini ..... 4/610
6,302,502 B1 * 10/2001 Larsen, Jr. ..... 312/334.4
6,694,543 B2 * 2/2004 Moore ..... 4/610
7,076,815 B2 7/2006 Orpilla
D636,660 S 4/2011 O'Connell
7,926,127 B2 4/2011 Barrese
7,987,534 B2 8/2011 Lin
8,015,633 B2 9/2011 Ho
8,069,507 B2 12/2011 Didehvar
2012/0152872 A1 * 6/2012 Didehvar ..... 211/105.4

* cited by examiner

*Primary Examiner* — Janie Christiansen
(74) *Attorney, Agent, or Firm* — Andrew W. Chu; Craft Chu PLLC

(57) ABSTRACT

An embodiment of the present invention is a shower rod assembly including a first tube, a second tube aligned with the first tube, a rod between the first tube and the second tube, a sleeve member, a bracket device, and a locking device. The rod has a macro adjustment portion, a threaded insert, and a stop member positioned between the macro adjustment portion and the threaded insert. The sleeve member slides over the tubes and can cover the rod between the tubes. The second tube engages the macro adjustment portion for a set length when the locking device is engaged. The first tube engages the threaded insert for micro adjustment of the set length to a locked length. Each bracket device has a base body with ridges, a casing with an inner core, a lock on the side of the casing and a mount.

11 Claims, 4 Drawing Sheets

SHOWER ROD WITH MACRO AND MICRO ADJUSTMENT

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to a generally curved shower curtain rod assembly for installation in a bathtub/shower enclosure.

2. Description of Related Art Including Information Disclosed Under 37 CFR 1.97 and 37 CFR 1.98

Typical bathrooms include a bathtub with a shower nozzle mounted on a wall above the tub, so that the bathtub functions as a shower as well as a bathtub. Other enclosures can also function as a shower, as long as there are walls on three sides of the bathtub/shower enclosure. The back wall has two opposing walls extending from both ends, so that an open side of the bathtub/shower enclosure remains accessible for the user. The shower nozzle may be mounted on either of the back wall or an opposing wall.

The open side requires a covering so that water spray from the shower nozzle stays within the bathtub/shower enclosure. It is well known to use a shower curtain suspended from a shower rod for this purpose. This prior art shower rod attaches to the two opposing walls across the open side. The prior art shower rod is a straight bar with variable or fixed length with ends attached to the opposing walls. Various attachments means have been used for the mounting of the prior art shower rod, including drilling holes, adhesives, and friction fit devices to lock the shower rod in place and to sustain the weight of a shower curtain.

Bathtub/shower enclosures have various sizes and dimensions. The three walls can have different surfaces and different lengths. Generally, the opposing walls are parallel to each other to allow for a shower rod to be mounted across the opposing walls, regardless of the length between the two opposing walls. Shower rods have adapted to fit in any size enclosure. For example, shower rods have telescoping lengths, special brackets, extension pieces, and curvatures. The variable length fits the different size enclosures; brackets allow attachment to the opposing walls in different situations; and curvature of the shower rod creates extra space in the enclosure and addresses curved bathtubs.

The curved shower rod presents special problems. First, variable length is complicated by the curvature. The curved rod increases in length and depth. As the curved rod lengthens, the arc of curvature increases, which changes the angles at the end of the shower rod for attachment and affects the stability of the shower rod. Special mounting brackets have evolved to account for these new angles and curvature as the length of the curved shower rod varies, such as pivots, ball-socket, and hinged brackets. Second, the telescoping tubes are not easily adjustable. The twisting action to extend the straight rod differs from the twisting action of a curved rod.

The curved rod is more unstable with axial movement, unlike a straight shower rod. Additionally, it is virtually impossible to friction fit a curved rod in the enclosure because the ends of the rod do not remain flush to the opposing walls. Any adhesive or longitudinal pressure through the length of the shower rod pulls or twists the bracket from the opposing wall. The force does not remain orthogonal to the surface of the wall, resulting in distortion and weakened attachment to the opposing walls of the enclosure.

It is an object of the present invention to provide an embodiment of the shower rod assembly with curvature and adjustable length.

It is another object of the present invention to provide an embodiment of the shower rod assembly with curvature and adjustable length that can be easily and quickly adjusted.

It is still another object of the present invention to provide an embodiment of the shower rod assembly with curvature and adjustable length with a bracket for friction fit attachment to the enclosure.

It is still another object of the present invention to provide an embodiment of the shower rod assembly with curvature and adjustable length with a bracket for adhesive attachment to the enclosure.

It is yet another object of the present invention to provide an embodiment of the shower rod assembly with curvature and adjustable length with improved attachment strength to the enclosure.

It is yet another object of the present invention to provide an embodiment of the shower rod assembly with curvature and adjustable length which can maintain position of the curvature relative to the enclosure.

It is an object of the present invention to provide an embodiment of the shower rod assembly with curvature and adjustable length with a quick and easy first length macro adjustment for installation.

It is an object of the present invention to provide an embodiment of the shower rod assembly with curvature and adjustable length with a second threaded micro adjustment for installation.

These and other objectives and advantages of the present invention will become apparent from a reading of the attached specifications and appended claims.

SUMMARY OF THE INVENTION

An embodiment of the present invention is a shower rod assembly comprising a first tube, a second tube, a rod between the tubes, a sleeve member, a bracket means, and a locking means. Each tube is generally hollow and has a mounting end for engaging a bracket means. The bracket means attaches to the wall of an enclosure for installation. The tubes and rod adjust the length for a secure fit in the enclosure.

The rod includes a macro adjustment portion, threaded insert, and a stop cam. The second tube engages the macro adjustment portion, which can be locked in place relative to the second tube at a set length when the locking means, such as a locking pin or locking screw, is removed. The first tube engages the threaded insert for micro adjustment of the set length to a locked and tensioned length. The threaded insert threadedly engages the first tube and pushes the stop cam away from the first tube as the first tube is adjusted toward the wall of the enclosure. Pressure is exerted through the tubes and rod to the bracket devices at the opposite ends of the tubes for improved attachment and resistance to rotation.

Each bracket device has a base body with ridges, a casing with an inner core, a lock on the side of the casing and a mount. Each tube has a respective bracket device to attach to a respective wall of the enclosure for installation. Each mounting end of the first and second tubes engages a respective casing and inner core of a respective bracket device. Because each mounting end is generally hollow, the respective inner core fits inside the tube and a respective casing fits around the outside of the tube. The lock holds the tube relative to the bracket to maintain position and rotation of each tube.

An embodiment of the present invention further includes a sleeve member to cover the exposed rod between the tubes. Also, the micro adjustment with the threaded insert can be installed on both ends of the rod, when each of the first and second tubes has a threaded end. The threads of each tube may be wound opposite to each other to prevent over rotation.

DETAILED DESCRIPTION OF THE DRAWINGS

Figure 1A:
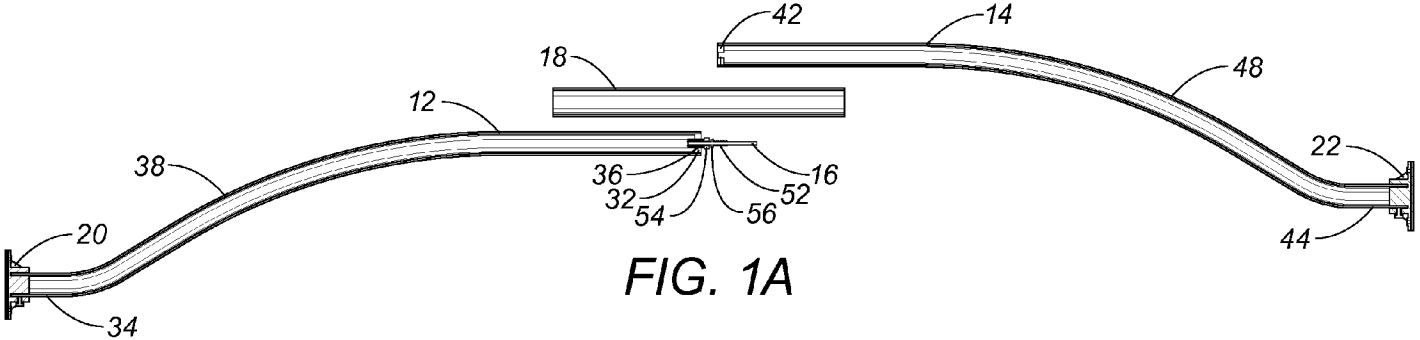
FIG. 1A is an exploded schematic view of an embodiment of the shower rod assembly of the present invention.
Figure 1B:
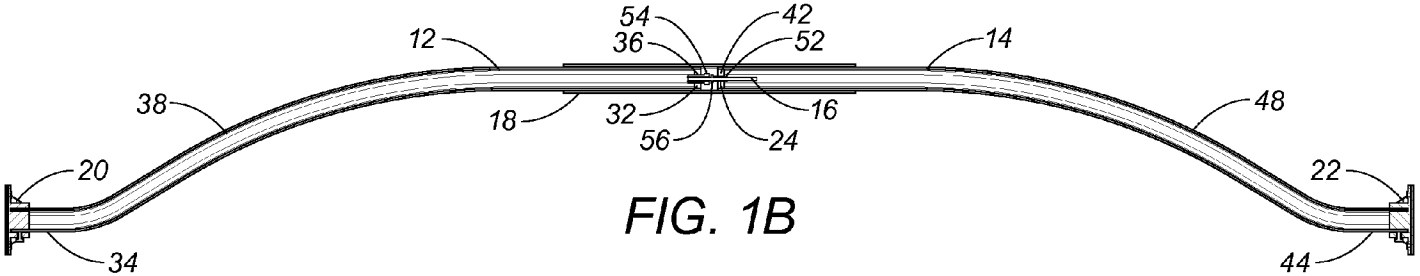
FIG. 1B is another schematic view of the embodiment of FIG. 1A, showing an open position.
Figure 1C:
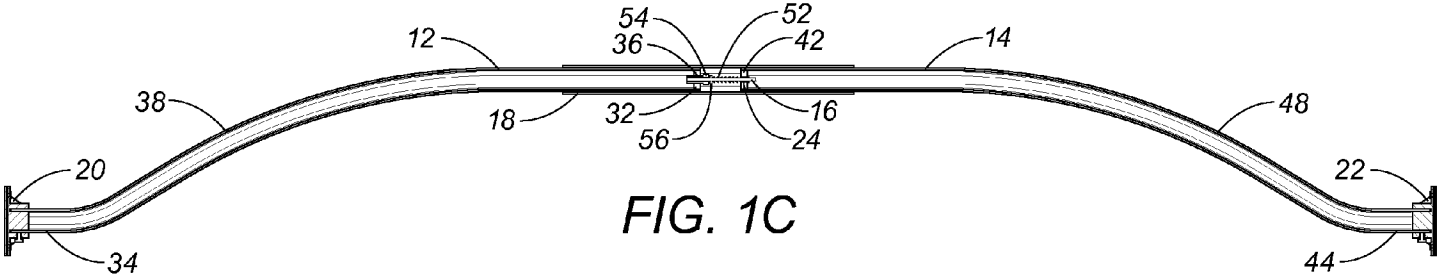
FIG. 1C is another schematic view of the embodiment of FIG. 1A, showing a locked and tensioned position.

FIGS. 1A, 1B, 1C, 2 and 3 show an embodiment of the shower rod assembly 10 of the present invention. The shower rod assembly 10 forms a curved curtain rod with variable length for installation in a bathtub/shower enclosure of any size. FIG. 1A shows the shower rod assembly 10 including a first tube 12, a second tube 14, a rod 16, a sleeve member 18, a first bracket means 20, a second bracket means 22, and a locking means 24. The length of the shower rod assembly 10 measures from one end of the first tube 12 to the opposite end of the second tube 14, with respective bracket means 20, 22 capping these ends of the first and second tubes 12, 14. The bracket means 20, 22 contact the walls of the bathtub/shower enclosure for installation. FIGS. 1B and 1C disclose the overall length of the shower rod assembly 10 as spanning from the back of the first bracket means 20, the first tube 12, the rod 16, the second tube 14, and the back of the second bracket means 22.

As shown in FIGS. 1A-1C and FIGS. 2-3, the first tube 12 is generally hollow and has a threaded end 32 and a first mounting end 34. The threads 36 of the threaded end 32 are axially aligned with the length of the first tube 12. The second tube 14 is also generally hollow and has a blocked end 42 and a second mounting end 44. The blocked end 42 has a hole 45 aligned with the second tube 14 and a stop block 46. The mounting ends 34, 44 are on opposite ends of the assembly 10 in FIGS. 1B and 1C.

To form the curvature, the first tube 12 further comprises a first arcuate portion 38 between the first mounting end 34 and the threaded end 32; and the second tube 14 further comprises a second arcuate portion 48 between the second mounting end 44 and the blocked end 42. These mounting ends 34, 44, the threaded end 32 and the blocked end 42 are linear, such that these ends 32, 34, 42, 44, can be aligned and parallel. Longitudinal pressure can be exerted through the assembly 10 due to the partial linear and straight portions. The arcuate portions 38, 48 still provide the benefit of a curved shower rod with the extra volume formed in the enclosure. The first arcuate portion 38 and the second arcuate portion 48 have identical curvature in FIGS. 1A-1C, so that the overall curvature of the assembly 10 is consistent.

Figure 2:
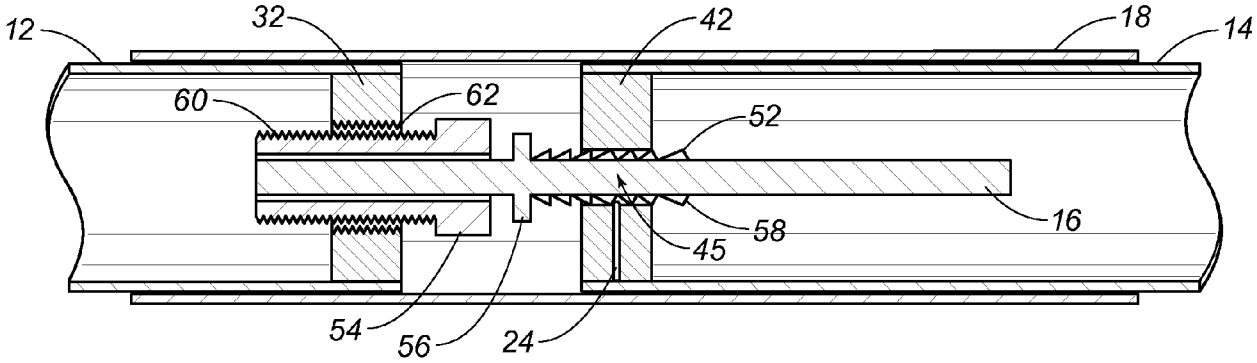
FIG. 2 is an enlarged sectional view of an embodiment of the shower rod assembly of the present invention, showing an open position.
Figure 3:
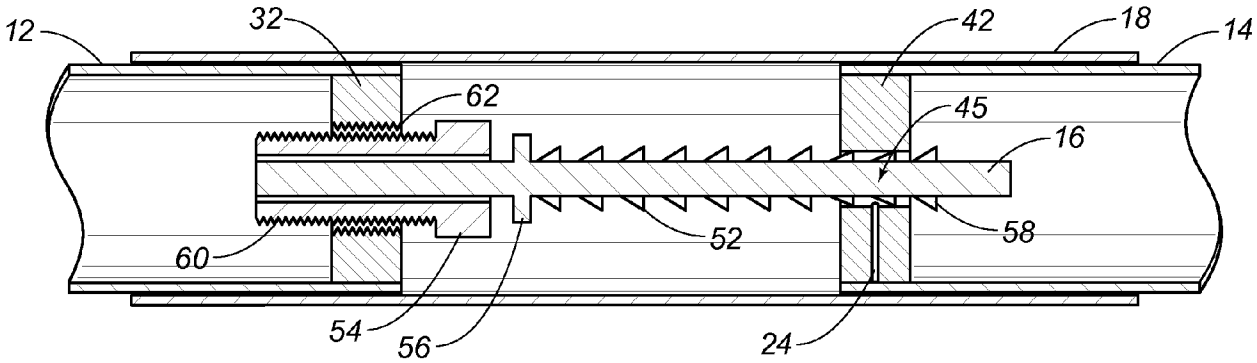
FIG. 3 is an enlarged sectional view of the embodiment of FIG. 2, showing a locked and tensioned position.

FIGS. 2 and 3 show enlarged views of the rod 16 of an embodiment of the present invention. The rod 16 engages both the first tube 12 and the second tube 14, extending in alignment between the threaded end 32 of the first tube 12 and the blocked end 42 of the second tube 14. FIG. 1C shows the rod 16 positioned between the tubes 12, 14. The rod 16 comprises a macro adjustment portion 52, a threaded insert 54, and a stop member 56. The macro adjustment portion 52 engages the second tube 14 and extends through the hole 45 of the blocked end 42. The macro adjustment portion 52 has an adjustment surface to engage the stop block 46. The adjustment surface can be comprised of a plurality of knuckles 58 along the rod 16 or other graded surface to engage the locking means 24. For example, a textured surface that can be gripped by a screw, large threads, square shoulders, and other type structures can be formed on the macro adjustment portion 52. FIGS. 2 and 3 show the plurality of knuckles 58 as one possible embodiment. The locking means 24 extends through the stop block 46 to contact at least one knuckle 58, holding the rod 16 in place relative to the second tube 14. The locking means 24 can be comprised of a locking pin to be inserted or a locking screw for threaded engagement through the stop block 46. Other known locking means 24, such as adhesives or levers or other structures can be used to engage the macro adjustment portion 52, locking the position of the second tube 14 for macro adjustment. The locking means 24 may be removably attached by any attachment means, including but not limited to a peg/peghole and screw threads/threaded stop block 46. The threaded insert 54 engages the first tube 12 and has outer threads 60 compatible with the threads 62 of the threaded end 42. At the tip of the rod 16, the axial portion 41 inserts into the threaded insert 54 and freely rotates around the rod 16. The axial portion 41 is on an end or tip of the rod 16 opposite the macro adjustment portion 52. The axial portion 41 rotates within the threaded insert 54 independent from threaded engagement of the threaded insert 54 to the first tube 12. The stop member 56 remains positioned between the macro adjustment portion 52 and the axial portion 41 with the threaded insert 54. The stop member 56 has an abutment position with the stop member 56 adjacent the threaded insert 54 as shown in FIG. 3. The translational movement of the stop member 56 in the abutment position corresponds to movement of the second tube 14 away from the first tube 12. The threaded insert 54 has outer threads 60 and a crank portion. The crank portion 43 is cam that controls the rotation of the outer threads 60. The crank portion 43 has a contact surface that can be manually operated or engage a tool, such as a wrench. Turning the crank portion 43 rotates the outer threads 60. FIGS. 2 and 3 show the outer threads 60 of the insert 54 as smaller than the knuckles 58 of the knuckled portion 52. The length adjustment is faster by moving the second tube 14 along the macro adjustment portion 52, but less precise than moving the first tube 12 along the threaded insert 54. The stop member 56 is positioned between the macro adjustment portion 52 and the threaded insert 54.

FIGS. 2 and 3 further show the sleeve member 18 from FIGS. 1A-1C. The sleeve member 18 fits around either the first tube 12, the second tube 14 or both because the diameter of the sleeve member 18 is greater than both tubes 12, 14. The sleeve member 18 has an aesthetic purpose to cover the exposed rod 16 between the tubes 12, 14, such that the sleeve member 18 slides between the first and second tubes 12, 14. The sleeve member 18 can be stored completely on either the first or second tube 12, 14 to allow access to the rod 16 and threaded insert 54. However, for installation, the sleeve member 18 covers the rod 16 between the first tube 12 and the second tube 14, fitting over both tubes 12, 14 concurrently.

Figure 6A:
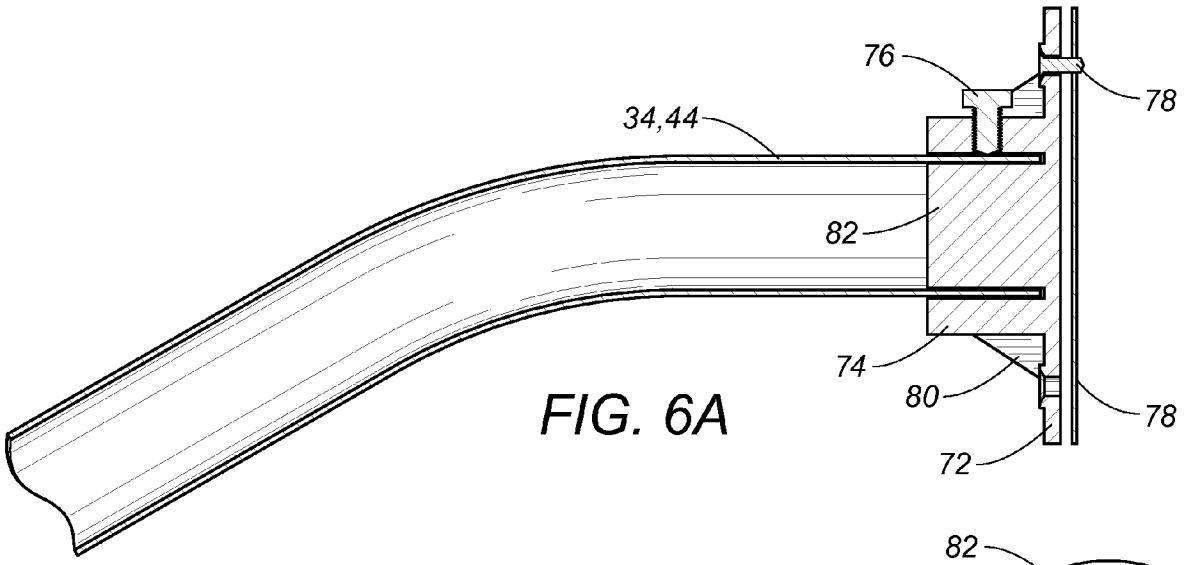
FIGS. 6A and 6B are a cross-sectional view and perspective view of the bracket of an embodiment of the shower rod assembly of the present invention.
Figure 6B:
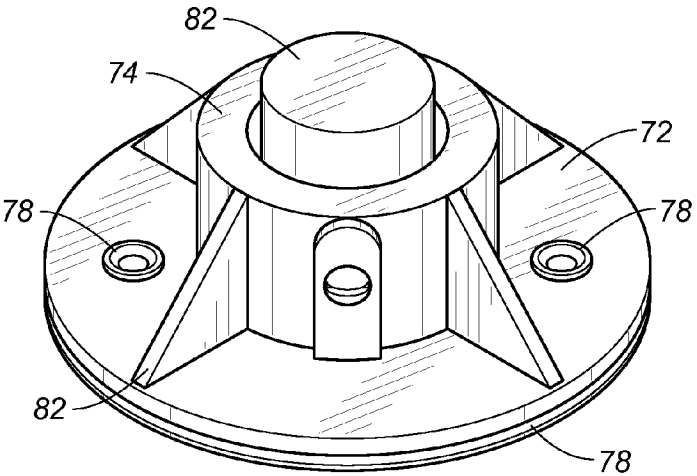

The first and second bracket means 20, 22 are best shown in FIGS. 6A and 6B in the sectional and perspective views, respectively. The first bracket means 20 engages the first mounting end 34 of the first tube 12, and the second bracket means 22 engages the second mounting end 44 of the second tube 14 for installation. Each of the first bracket means 20 and the second bracket means 22 are virtually identical, and the bracket means 20, 22 are placed on opposite sides of the assembly 10, facing each other. The back sides of the bracket means 20, 22, contact the walls of the enclosure for fixing the position of the assembly 10 in the enclosure.

Each bracket means 20, 22, comprises a base body 72 with ridges 80, a casing 74, a locking means 76, and a mounting means 78. The base body 72 is generally round and formed of a strong and resilient material to handle the weight of the tubes 12, 14 and a shower curtain. The ridges 80 provide extra strength and durability. The mounting means 78 can be placed on the back of the base body 72 for contacting the wall of the enclosure for installation. Any known prior art mounting can be used at the mounting means 78, such as an adhesive or screws and screw holes. The adhesive type mounting means uses friction to maintain the position on the wall of the enclosure. Although drilling into dry wall or plaster for mounting screws is another mounting means.

The casing 74 has an inner core 82, being centered on the base body 72. The locking means 76 is placed on a side of the casing 74. Each mounting end 34, 44 of the first tube 12 and the second tube 14 engages a respective casing 74 and inner core 82 of a respective bracket means 20, 22. The inner core 82 can remain flush with the height of the casing 74. Alternatively, the inner core 82 may extend above the casing 74 or remain below within the casing 74. The generally hollow mounting end 34, 44 fits a respective inner core 82 inside the respective tube 12, 14 and a respective casing 74 around an outside of the respective tube 12, 14, as shown in FIGS. 1A-1C. Once loaded into the bracket means 20, 22, the respective locking means 76 is activated. The locking means 76 can comprise at least one locking screw 84, which threads through the side of the casing 74 to contact and hold the tube 12, 14 in place relative to the base body 72. The prior art known locking means 76 abuts against each mounting end 34, 44 of the first tube 12 and the second tube 14 to hold position and prevent rotation of each mounting end 34, 44.

The method of installing the shower rod assembly 10 relates to a bathtub/shower enclosure with three walls and an open side. The assembly 10 is mounted against opposing walls across the open side. Each bracket means 20, 22 is attached to each mounting end 34, 44 of the first tube 12 and the second tube 14. The threaded insert 54 of the rod 16 attaches to the threaded end 32 of the first tube 12 by threaded engagement of the threads 62 and the outer threads 60 of the insert 54. The macro adjustment portion 52 of the rod 16 inserts into the hole 45 of the blocked end 32 of the second tube 14. The first tube 12 and the second tube 14 can now be positioned within the enclosure and adjusted along the rod 16 for a set length. Then, the locking means 24 engages the stop block 46 at the blocked end 42 to fix the set length of the assembly 10. Further micro adjustments are made by cranking the threaded insert 54 along the threads 62 of the first tube 12. The cranking includes rotating the cam of the threaded insert 54 to move the outer threads 60 along the threads 62 of the first tube. The cam can be rotated manually or with a tool, such as a wrench or ratchet. The set length is increased to a locked and tensioned length by movement of the first tube 12 away from the stop member 56 of the rod 16. Each bracket means 20, 22 is then fixed by respective mounting means 78 for a locked and installed position of the first tube 12 and the second tube 14.

The micro adjustment step adjusts the locked length set by the macro adjustment portion 52 and the locking means 24. The micro adjustment is more precise because the magnitude of the threads 62 in the threaded end 32 and outer threads 60 of the insert 54 are smaller than the knuckles 58 in FIGS. 2 and 3. In alternative embodiments, the micro adjustment is more precise because of the use of the threads 62 to change the length, while the adjustment surface of the macro adjustment portion 52 cannot be adjusted with the same measured precision. The insert 54 abuts the stop member 56, while remaining rotatable around the rod 16 for cranking, the first tube 12 moving away from the second tube 14 thread by thread. Furthermore, the threads 62 of the first tube 12, the outer threads 60 of the rod 16, the macro adjustment portion 52 of the rod 16, and the locking means 24 exert a compressive force on each mounting means 78 of each bracket means 20, 22. The force increases the efficacy of any adhesive of the mounting means 78 by pressing harder against the wall of the enclosure. The linear portions align the force to resist twisting and distortion, which may pull the bracket means 20, 22 from the walls of the enclosure.

Figure 4:
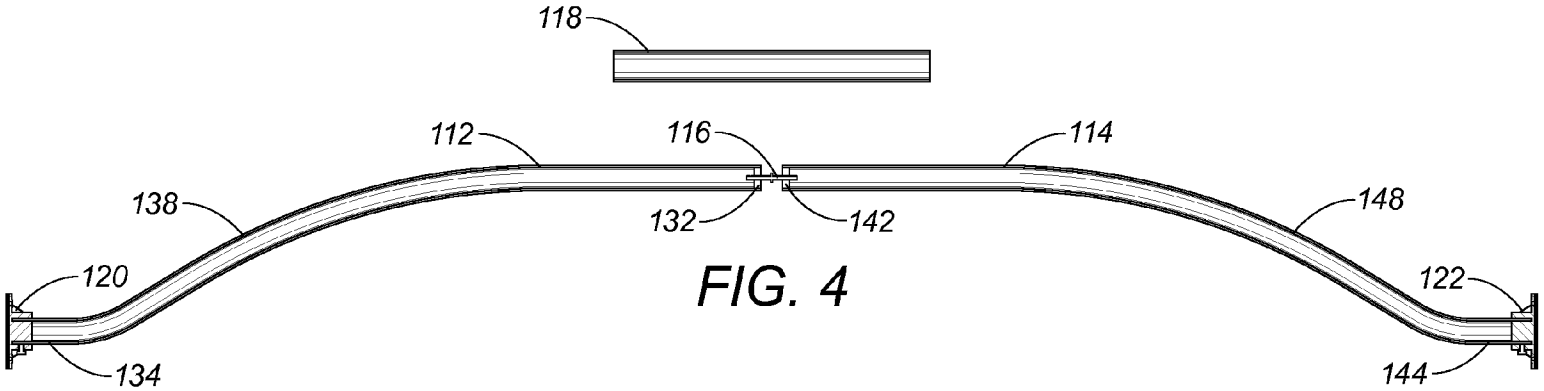
FIG. 4 is an exploded schematic view of another embodiment of the shower rod assembly of the present invention.
Figure 5:
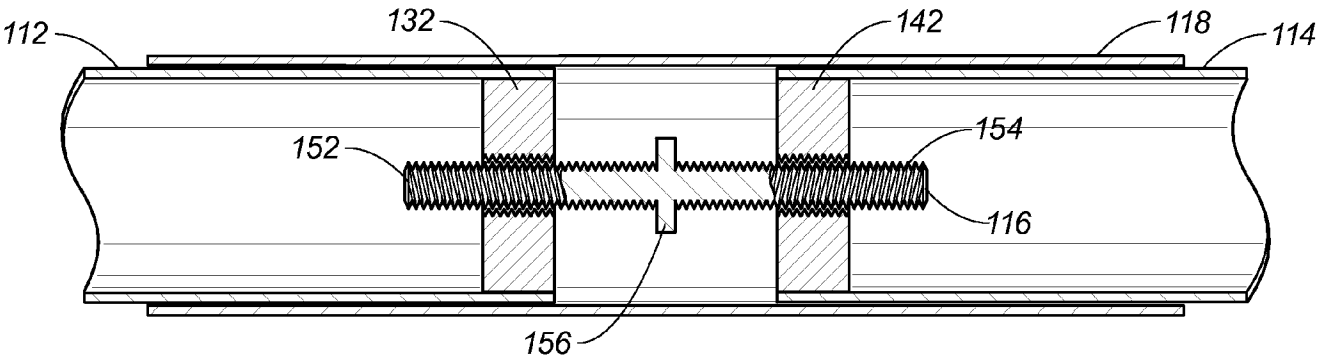
FIG. 5 is an enlarged sectional view of the embodiment of FIG. 4.

FIGS. 4 and 5 show another embodiment of the shower rod assembly 110 with micro adjustment on both tubes. This embodiment comprises a first tube 112, a second tube 114, a rod 116, a sleeve member 118, a first bracket means 120, and a second bracket means 122. The first tube 112 is also generally hollow and has a first threaded end 132 and a first mounting end 134. The second tube 114 is also generally hollow and has a second threaded end 142 and a second mounting end 144. The threads 162 of the first threaded end 132 are axially aligned with the length of the first tube 112, and the threads 163 of the second threaded end 142 are axially aligned with the length of the second tube 114. Notably, the threads 163 of the second tube 114 are wound opposite the threads 162 of the first tube 112.

FIG. 5 shows the rod 116 of the assembly 110 engaging the first tube 112 and the second tube 114. In this view, the rod 116 has a first threaded portion 152 engaging the threads 62 of the first tube 112 and a second threaded portion 154 engaging the threads 163 of the second tube 114. As such, the second threaded portion 154 is wound opposite the first threaded portion 152. There is also a stop member 156 positioned between the first threaded portion 152 and the second threaded portion 154, marking the change in threading along the rod 116. The rod 116 is positioned in alignment between the threaded end 132 of the first tube 112 and the threaded end 142 of the second tube 114.

FIG. 4 shows the sleeve member 118 fitting around either the first tube 112, the second tube 114 or both, as in similar embodiments. The sleeve member 118 remains slidably positioned between the first and second tubes 112, 114. FIG. 4 also shows the sectional view of the first bracket means 120 engaging the first mounting end 134 of the first tube 112, and a second bracket means 122 engaging the second mounting end 144 of the second tube 114 for installation. These bracket means 120, 122 are also analogous to the bracket means 20, 22 of a previous embodiment. These bracket means 120, 122 are identical and perform the same positioning and mounting functions as in the previous embodiment.

In this other embodiment, the shower rod assembly 110 achieves the same curvature with linear portions. The first tube 112 further comprises a first arcuate portion between the first mounting end 134 and the first threaded end 132, and the second tube 114 further comprises a second arcuate portion between the second mounting end 144 and the second threaded end 142. The first arcuate portion and the second arcuate portion have identical curvature, as shown in FIG. 4.

The method of installation for this assembly 110 includes the step of adjusting to a set length and a locked and tensioned length as the same micro adjustment. The stop cam is cranked to expand or contract the first tube 112 and the second tube 114. The opposite windings coordinate the movement so that both tube 112, 114 move closer together or further apart. Further cranking to move further apart generates the compression force exerted against the bracket means 120, 122 against the walls of the enclosure. Instead of the less precise knuckles on one tube, the present embodiment has micro adjustment for both tubes 112, 114.

In the embodiments of the present invention, the shower rod assembly has an innovative curvature and adjustable length. The curvature includes arcuate portions and linear portions for controlling the force exerted on the bracket means. Prior art curved rods cannot re-direct compressive force as taught by the present invention. Furthermore, the adjustable length is easy and quick because of the rod with the macro adjustment portion. Large adjustments can be made with this rod and macro adjustment surfaces, such as knuckles. Micro adjustments can be made with this rod and threaded ends of the tubes. The micro adjustments friction fit a bracket for attachment to the enclosure, for instance, pressuring adhesive flush against the walls of the enclosure. The brackets further resist twisting and rotation of the tubes in the brackets, so that the curvature is not lowered or tilted. The locking of the tubes within the volume created by the inner core and casing of each bracket resists buckling and downward twisting of the curvature during installation. The assembly, although curved, maintains position across the open side of the enclosure. Installation is made easier because of the quick adjust by the knuckles and the fine adjustment by the threaded insert during installation.

The foregoing disclosure and description of the invention is illustrative and explanatory thereof. Various changes in the details of the illustrated structures, construction and method can be made without departing from the true spirit of the invention.

I claim:

1. A shower rod assembly comprising:

a first tube, being generally hollow and having a threaded end and a first mounting end, wherein threads of said threaded end are axially aligned with the length of said first tube;

a second tube, being generally hollow and having a blocked end and a second mounting end, said blocked end having a hole aligned with said second tube and a stop block;

a rod engaging said first tube and said second tube, extending in alignment between said threaded end of said first tube and said blocked end of said second tube;

wherein said rod comprises:

a macro adjustment portion engaging said second tube and extending through said hole of said blocked end and having an adjustment surface along said rod;

a threaded insert means engaging said first tube and having outer threads compatible with said threads of said threaded end, said threaded insert means being in threaded engagement to said first tube, rotatable around said rod;

an axial portion being inserted into said threaded insert means, said axial portion being on an end of said rod opposite said macro adjustment portion, wherein said axial portion rotates within said threaded insert means independent from said threaded engagement of said threaded insert to said first tube; and a stop member positioned between said macro adjustment portion and said axial portion, wherein said stop member has an abutment position with said stop member adjacent said threaded insert means, and wherein translational movement of said stop member in said abutment position corresponds to movement of said second tube away from said first tube;

a sleeve member fitting around either said first tube, said second tube or both, said sleeve member being slidably positioned between the first and second tubes;

a first bracket means engaging said first mounting end of said first tube for installation and a second bracket means engaging said second mounting end of said second tube for installation, each of said first bracket means and said second bracket means being identical; and a locking means being removably attached to said blocked end to engage said rod through said stop block.

2. The shower rod assembly according to claim 1, wherein said first tube further comprises a first arcuate portion between said first mounting end and said threaded end, said first mounting end and said threaded end being linear, and wherein said second tube further comprises a second arcuate portion between said second mounting end and said blocked end, said second mounting end and said blocked end being linear.

3. The shower rod assembly according to claim 2, said first mounting end, said threaded end, said second mounting end, and said blocked end being aligned and parallel.

4. The shower rod assembly according to claim 2, said first arcuate portion and said second arcuate portion having identical curvature.

5. The shower rod assembly according to claim 1, wherein said adjustment surface of said macro adjustment portion is comprised of a plurality of knuckles along said rod, and wherein said outer threads of said insert are smaller than said knuckles of said macro adjustment portion.

6. The shower rod assembly according to claim 1, wherein said sleeve member covers said rod between said first tube and said second tube, fitting over both tubes concurrently.

7. The shower rod assembly according to claim 1, each bracket means comprising:

a base body with ridges;

a casing with an inner core, being centered on said base body;

a locking means on a side of said casing; and a mounting means for installation on a side of said base body opposite said casing.

8. The shower rod assembly according to claim 7, wherein each mounting end of said first tube and said second tube engages a respective casing and inner core of a respective bracket means, each mounting end being generally hollow with a respective inner core fitted inside and a respective casing fitted outside.

9. The shower rod assembly according to claim 8, wherein respective locking means comprises at least one locking screw, said at least one locking screwing abutting each mounting end of said first tube and said second tube to hold position and rotation of each mounting end.

10. The shower rod assembly according to claim 7, wherein said mounting means is comprised of an adhesive.

11. The shower rod assembly according to claim 7, wherein said mounting means is comprised of at least one screw hole and a mounting screw.

* * * * *